US007568535B2

(12) United States Patent
Larson et al.

(10) Patent No.: US 7,568,535 B2
(45) Date of Patent: Aug. 4, 2009

(54) METHODS FOR RECOVERY AND REUSE OF LOST CIRCULATION MATERIAL

(75) Inventors: Thomas Robert Larson, Montgomery, TX (US); Eric Simon Provost, Magnolia, TX (US)

(73) Assignee: National Oilwell Varco LP, Houston, TX (US)

( * ) Notice: Subject to any disclaimer, the term of this patent is extended or adjusted under 35 U.S.C. 154(b) by 0 days.

(21) Appl. No.: 12/001,490

(22) Filed: Dec. 11, 2007

(65) Prior Publication Data

US 2009/0145664 A1 Jun. 11, 2009

(51) Int. Cl.
*E21B 21/06* (2006.01)

(52) U.S. Cl. ..... 175/66; 175/72; 175/206; 175/209; 166/75.12

(58) Field of Classification Search ..... None
See application file for complete search history.

(56) References Cited

U.S. PATENT DOCUMENTS

| | | | | |
|---|---|---|---|---|
| 2,870,990 | A | 1/1959 | Bergey | 175/66 |
| 2,919,898 | A | 1/1960 | Marwil et al. | 209/211 |
| 2,941,783 | A | 6/1960 | Stinson | 175/66 X |
| 2,954,871 | A | 10/1960 | Lummus et al. | 209/211 |
| 3,016,962 | A | 1/1962 | Lummus et al. | 175/66 |
| 3,025,965 | A | 3/1962 | Bergman et al. | 209/211 |
| 3,150,726 | A | 9/1964 | Bodine | |
| 3,353,673 | A | 11/1967 | Vismas | |
| 3,766,997 | A | 10/1973 | Heilhecker et al. | 175/66 |
| 3,926,787 | A | 12/1975 | Gay | 209/3 |
| 3,964,557 | A | 6/1976 | Juvkam-Wold | 175/66 |
| 4,090,523 | A | 5/1978 | Kelly, Jr. et al. | 134/18 |
| 4,116,288 | A | 9/1978 | Love | 175/66 |
| 4,192,392 | A | 3/1980 | Messines et al. | 175/66 |
| 4,216,836 | A | 8/1980 | Rayborn | 175/66 |
| 4,226,708 | A | 10/1980 | McCartney | 209/211 |
| 4,319,991 | A | 3/1982 | Crone, Jr. et al. | 209/255 |
| 4,482,459 | A | 11/1984 | Shiver | 210/639 |
| 4,636,308 | A | 1/1987 | Summers | 210/195.1 |
| 4,711,720 | A | 12/1987 | Young | |
| 5,037,558 | A | 8/1991 | Kalnins | 210/702 |
| 5,108,608 | A | 4/1992 | Carroll | 210/512.1 |
| 5,108,626 | A | 4/1992 | Lees et al. | 210/785 |
| 5,225,082 | A | 7/1993 | Young et al. | 210/512.1 |
| 5,229,018 | A | 7/1993 | Forrest | 252/8.551 |
| 5,273,629 | A | 12/1993 | Meenan et al. | 204/131 |
| 5,582,727 | A | 12/1996 | Foster | 210/258 |

(Continued)

FOREIGN PATENT DOCUMENTS

GB 2089403 A 12/1981

OTHER PUBLICATIONS

Solids Control Handbook, Sweco Oilfield Services, cover page, introductory page, pp. 21-48; 1988.

(Continued)

*Primary Examiner*—Zakiya W. Bates
(74) *Attorney, Agent, or Firm*—Guy McClung

(57) ABSTRACT

A system for recovering lost circulation material from spent drilling fluid, the spent drilling fluid containing lost circulation material, drilling fluid, and undesirable solids, the system having alternating separation apparatuses, including sizing apparatus, destiny/shear separation apparatus, and sizing apparatus; and methods for using such a system.

17 Claims, 3 Drawing Sheets

U.S. PATENT DOCUMENTS

| | | | | |
|---|---|---|---|---|
| 5,858,237 | A | 1/1999 | Hashmi et al. | 210/512.1 |
| 5,861,362 | A | 1/1999 | Mayeux et al. | 507/104 |
| 6,106,733 | A | 8/2000 | Wood | 210/774 |
| 6,138,834 | A | 10/2000 | Southall | 209/17 |
| 6,237,780 | B1 | 5/2001 | Schulte | 210/388 |
| 6,371,306 | B2 | 4/2002 | Adams et al. | 210/388 |
| 6,457,588 | B1 | 10/2002 | Schulte et al. | 210/388 |
| 6,458,283 | B1 | 10/2002 | Adams et al. | 210/780 |
| 6,510,947 | B1 | 1/2003 | Schulte et al. | 210/388 |
| 6,517,733 | B1 | 2/2003 | Carlson | 210/785 |
| 6,527,054 | B1 | 3/2003 | Fincher et al. | 166/357 |
| 6,533,946 | B2 | 3/2003 | Pullman | 210/787 |
| 6,596,169 | B1 | 7/2003 | Rang et al. | 210/512.1 |
| 6,662,952 | B2 | 12/2003 | Adams et al. | 209/319 |
| 6,808,626 | B2 | 10/2004 | Kulbeth | 210/241 |
| 6,855,261 | B2 | 2/2005 | Boutte et al. | 210/768 |
| 6,881,349 | B2 | 4/2005 | Mueller | 210/708 |
| 6,892,887 | B2 | 5/2005 | Rayborn | 209/17 |
| 6,953,097 | B2 | 10/2005 | Seyffert | 175/66 |
| 7,004,333 | B2 | 2/2006 | Marcotullio et al. | 209/725 |
| 7,066,285 | B2 | 6/2006 | Shaarpour | 175/72 |
| 7,255,790 | B2 | 8/2007 | Rogers et al. | 210/512.1 |
| 7,278,804 | B2 | 10/2007 | Deal et al. | 400/197 |
| 7,293,657 | B1 | 11/2007 | Kelton et al. | 209/715 |
| 7,438,142 | B2 | 10/2008 | Butler et al. | 175/66 |
| 7,520,342 | B2 | 4/2009 | Butler | 175/66 |
| 2004/0069536 | A1 | 4/2004 | Cowan | 175/66 |
| 2007/0221411 | A1* | 9/2007 | Butler et al. | 175/66 |
| 2008/0135300 | A1 | 6/2008 | James | 175/66 |

OTHER PUBLICATIONS

The Handbook on Soilds Control & Waste Management, 4th Edition, Brandt, 1982.

Manual of Drilling Fluid Technology—Lost Circulation, NC Baroid NC Industries, Inc. pp. 5-15; 1985.

Introducing the gMax (tm) the eLIMINATOR. Fluid Systems Inc., 2 pp. 2006.

Environmentally Sound Cost-Effective Oilfield Waste Disposal, Sweco Oilfield Services, 4 pp. 1999.

Verti-G Cuttings Dryer. SWACO. 3 pp., 2004.

Hydro-VAC, NOV Brandt, 2 pp., 2007.

Separation of finest particles in hydrocyclones, Nesse et al Minerals Engineering 17 (2004), 8 pp.

Evaluation of the Bond Stability of a Particle-Bubble Complex in a Hydrocyclone and Sedimentation Scroll Centrifuge, Lagutkin et al, Chemical & Petroleum Engineering, vol. 39, 2003, pp. 195-201.

No Matter How lost circulation threatens your projects, MI has more ways to prevent and cure it than any other company, MI, 2002, 8 pp.

Int'l Search Report, Int'l App. No. PCT/GB2008/051043; 3 pp.: May 3, 2009 w/ Written Opinion of the Int'l Searching Authority, 6 pp.

* cited by examiner

METHODS FOR RECOVERY AND REUSE OF LOST CIRCULATION MATERIAL

BACKGROUND OF THE INVENTION

1. Field of the Invention

This invention is directed to systems and methods for recovering lost circulation material from wellbore fluids; and to systems and methods for providing such recovered material for reuse in drilling operations.

2. Description of Related Art

Drilling fluids, often called "mud," is, typically, a mixture of fluid and various additives which is pumped down through a hollow drill string (pipe, drill collar, bit, etc.) into a well being drilled and exits through holes in a drillbit. The mud picks up drilled cuttings, debris, and other solids from the well and carries them upwardly away from the bit and out of the well in a space (annulus) between the well walls and the drill string. At the top of the well, the solids-laden mud is discharged. In many instances it is fed to one or more shale shakers which have one or more screens for screening the material. A wide variety of vibrating screens, devices which use them, shale shakers, and screens for shale shakers are known. The screens catch and remove solids from the mud as the mud passes through them. If drilled solids are not removed from the mud used during the drilling operation, recirculation of the drilled solids can create weight, viscosity, and gel problems in the mud, as well as increasing wear on mud pumps and other mechanical equipment used for drilling.

In drilling a wellbore, the circulation of drilling fluid to and then away from the drill bit can cease due to the porosity of the formation and/or due to fracturing of the formation through which the wellbore is being drilled. This is referred to as "lost circulation." When lost circulation occurs, drilling fluid is pumped into the fractured formation rather than being returned to the surface. Often circulation is lost at some specific depth where the formation is "weak", and where a fracture extends horizontally away from the borehole. Expressions used to describe rocks that are susceptible to lost returns include terms like vugular limestone, unconsolidated sand, "rotten" shale, and the like.

To fill or seal off a porous formation or to fill or seal off a wellbore fracture so that a proper route for drilling fluid circulation is re-established, a wide variety of "lost circulation materials" have been pumped into wellbores. For purposes of classification, some lost circulation materials are generally be divided into fibers, flakes, granules, and mixtures.

It is often desirable, however, to retain the lost circulation material in the drilling mud system during continuous circulation. Screening the drilling mud in the usual manner for removal of undesired particulate matter can also result in the removal of the lost circulation material. Such screening can therefore require continuous introduction of new lost circulation material to the drilling mud downstream of the mud screening operation.

The addition of the lost circulation material compounds the separating problems because it, like the drilling fluid, is often cleaned and recirculated. Exiting the well is the drilling fluid with solids which includes valuable small sized particles such as clay minerals and weighting minerals, valuable lost circulation material of a large size, and with undesirable material spanning sizes from coarser than lost circulation material to sizes of the smallest of the valuable materials in the fluid. The function of the lost circulation material is to seal openings or gaps in an earth formation. Unfortunately, this lost circulation material, when pumped back to and through apparatuses at the surface, can plug up separator components, e.g. fine screen cloth on shale shaker screens. One proposed solution to this separation problem is a conventional two step screening process as shown in U.S. Pat. No. 4,116,288 in which an exiting mixture of drilling fluid, lost circulation material and undesirable material is first subjected to a coarse screening to separate the lost circulation material from the drilling fluid and undesirable material which drops to a second finer screen therebelow to separate the drilling fluid from the undesirable material. The drilling fluid and lost circulation material are then reunited for recirculation into the well. This system is susceptible to height restrictions and fine screen problems and can allow undesirable solids or pieces of the same size as lost circulation material to be circulated back into a well. Often the moist, fibrous lost circulation material will also be coated with finer undesirable material which will not go through a first screen and which is therefore circulated back into a well.

The art discloses a variety of mud pumping systems, mud processing systems, screening systems and screens, and lost circulation materials, including, and not by way of limitation, those disclosed in U.S. Pat. Nos. 4,116,288; 4,319,991; 5,229,018; 5,861,362; 6,371,306; 6,457,588; 6,458,283; and 6,510,947—all of said patents incorporated fully herein for all purposes.

SUMMARY OF THE PRESENT INVENTION

The present invention, in certain aspects, discloses methods and systems for separating lost circulation material from well fluids and, in certain particular aspects, methods for recycling such separated lost circulation material for reuse in drilling operations. In certain aspects, lost circulation material is separated from coarser pieces by both size separation (e.g. screening) and by density/fluid-shear separation (e.g. by subjecting material to a moving fluid, e.g. air, water, clean drilling fluid, or some other liquid component of a drilling fluid mixture).

In certain aspects, the present invention discloses methods and systems for providing cleaned lost circulation material for reuse in drilling operations.

In certain particular aspects, the lost circulation material is between 40 microns and 500 microns in a largest dimension.

The present invention, in certain aspects, discloses methods for recovering lost circulation material from a drilling fluid mixture, the drilling fluid mixture containing lost circulation material, drilling fluid, and undesirable solids, the method including: feeding a drilling fluid mixture to first sizing apparatus, the drilling fluid mixture containing lost circulation material, drilling fluid, and undesirable solids; separating with the first sizing apparatus coarse material from a stream of the drilling fluid mixture, and producing a stream of processed drilling fluid with the lost circulation material herein; providing the stream of processed drilling fluid with the lost circulation material to a hydrocyclone; producing with the hydrocyclone a first stream and a second stream, the first stream containing undesirable solids; the second stream containing substantially all of the lost circulation material in the processed drilling fluid, and some of the undesirable solids; feeding the second stream to second sizing apparatus; the second sizing apparatus producing a primary stream with substantially all of the lost circulation material, and a secondary stream with drilling fluid and undesirable solids; and feeding the primary stream to fluid processing apparatus, in one aspect for further processing for re-use in a wellbore operation.

The present invention, in certain aspects, discloses systems for recovering lost circulation material for re-use in a wellbore operation, the lost circulation material in a stream of spent drilling fluid, the spent drilling fluid also containing drilling fluid and undesirable solids, the system including: first sizing apparatus for receiving a stream of spent drilling fluid, the spent drilling fluid containing lost circulation material, drilling fluid, and undesirable solids, the first sizing apparatus for separating coarse material from the stream of spent drilling fluid, and producing a stream of processed spent drilling fluid with the lost circulation material therein; a hydrocyclone for receiving and processing the stream of processed spent drilling fluid, the hydrocyclone for producing a first stream and a second stream, the first stream containing undesirable solids, the second stream containing substantially all of the lost circulation material in the processed spent drilling fluid, and some of the undesirable solids; a second sizing apparatus for receiving and processing the second stream, the second sizing apparatus for producing a primary stream with substantially all of the lost circulation material, and a secondary stream with drilling fluid and undesirable solids; and fluid processing apparatus for feeding the primary stream for re-use in a wellbore operation.

Accordingly, the present invention includes features and advantages which are believed to enable it to advance drilling fluid treatment technology. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, effective, and non-obvious methods and systems for separating lost circulation material from drilling fluids; and New, useful, unique, efficient, non-obvious methods and systems for providing cleaned, separated lost circulation material for reuse in drilling operations.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

Figure 1A:
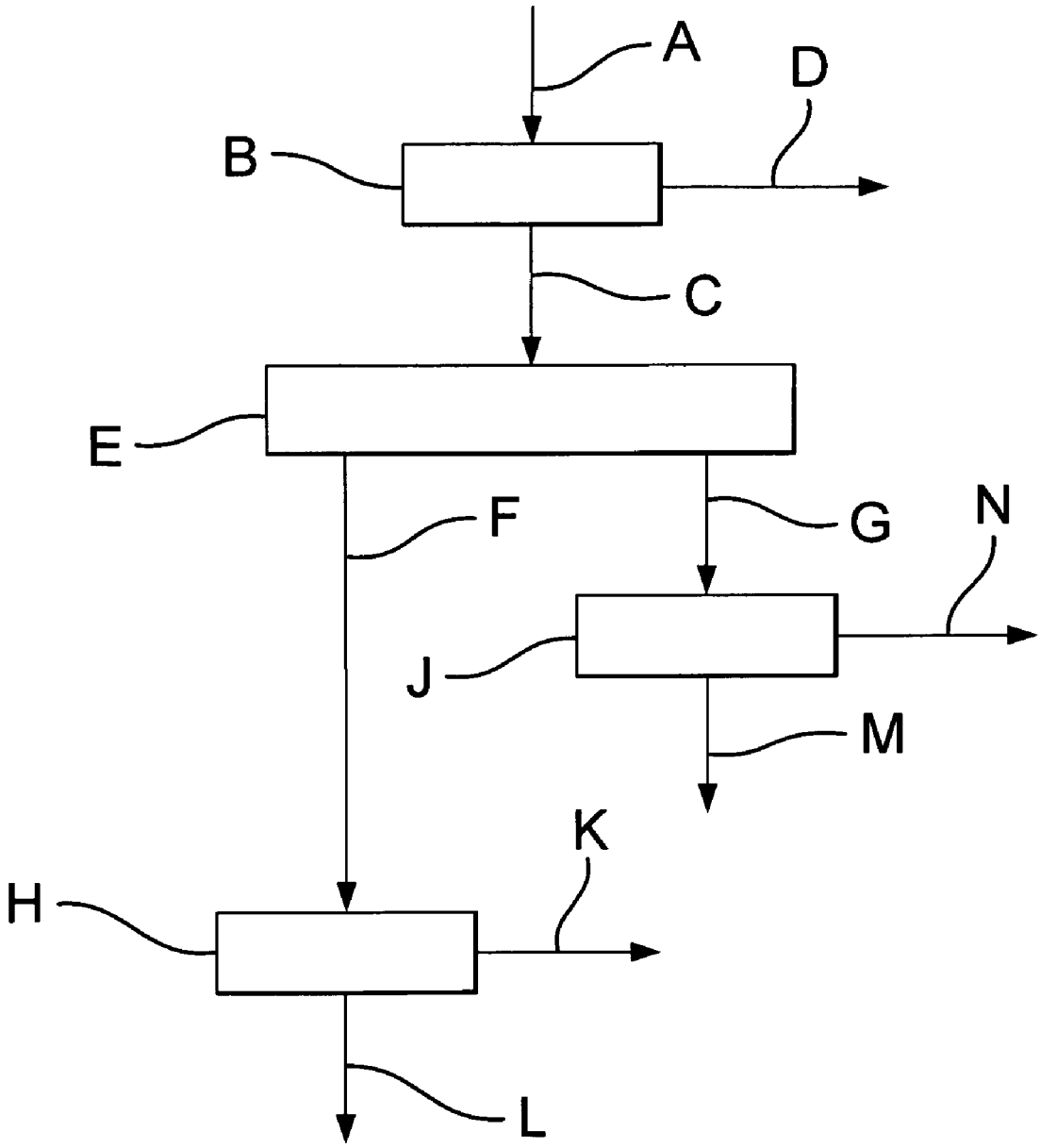
FIG. 1A is a schematic view illustrating a system and method according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein. No feature, aspect, step or element is critical or essential to the invention unless it is specifically referred to herein as "critical" or "essential."

DETAILED DESCRIPTION OF THE INVENTION

FIG. 1A illustrates a system S according to the present invention with an input feed stream A treated by a series of separation devices that follow an alternating pattern of size separation and fluid shear separation. The alternation of size and fluid shear separators is arranged to isolate, concentrate, and separate two granular materials having different specific gravity values out of an input fluid that carries a mixture of both materials. A separator B is a size separator, from which a stream C enters a density and fluid shear separator E, which produces two streams, F and G, both of which are then sent to size separators H and J. The stream C contains the coarse product of size separator B, which includes both coarse low specific gravity material and coarse high specific gravity material. In one aspect, the low specific gravity material is Lost Circulation Material to be recovered from a drilling fluid mixture and the high specific gravity material is undesirable drill cuttings, which are to be discarded A stream D produced by the separator B contains the undersize of the size separation made by separator B. The separator E is a fluid shear separator which produces stream F and stream G. Stream F contains the bulk of the low specific gravity coarse materials, and stream G contains high specific gravity materials. The separator H provides a size separation which produces a stream K containing the coarse low specific gravity solids, and a stream L containing drilling fluid (which may need additional processing). The separator J is also a size separator, but is processing only the high specific gravity solids coming from separator E (which in one case is the drill cuttings). A separator J produces a stream M containing high specific gravity coarse drilled solids with very little carrying fluid and a stream N containing fine high specific gravity solids and carrying fluid.

Figure 1B:
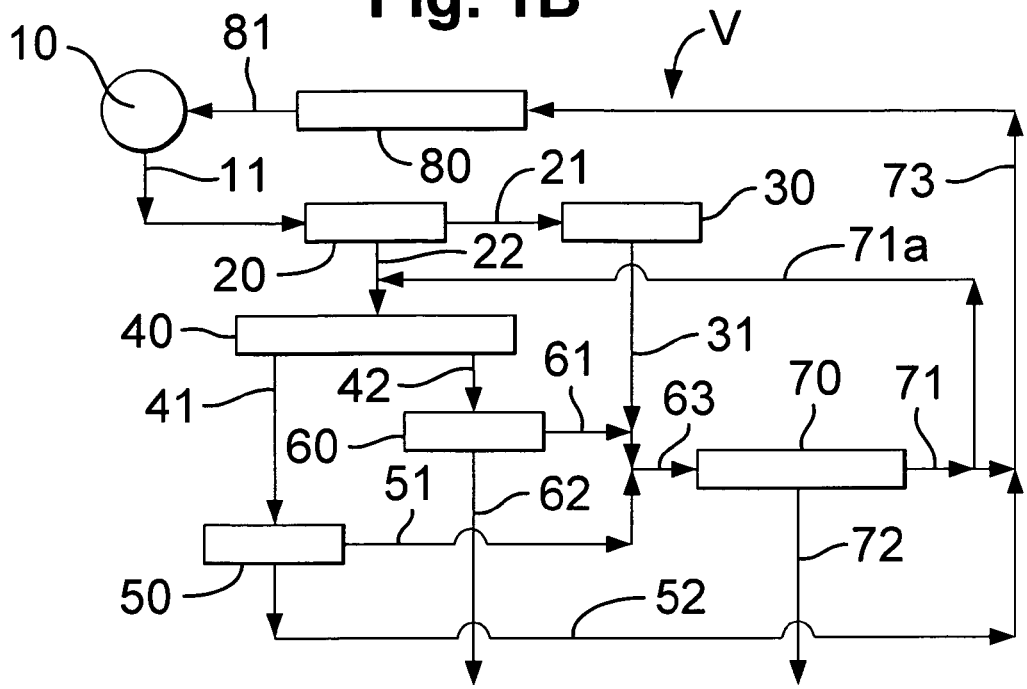
FIG. 1B is a schematic view illustrating a system and method according to the present invention.

FIG. 1B shows a schematic diagram of a system V according to the present invention with separators 20, 40, 50 and 60. The separator 20 corresponds to the separator B, FIG. 1A. The separators 40, 60, 50 correspond, respectively, to the separators E, J, and H. FIG. 1A. Spent drilling fluid is returned from a wellbore 10 in a line 11 to a first separating device 20 of an active rig mud system. This spent drilling fluid contains drilling fluid, drilled cuttings, debris and lost circulation material. The first separating device 20 accomplishes a size separation on the spent drilling fluid in a device such as a shale shaker, or a sieve bend, or any other such size separation apparatus known to those killed in the art for separating material from spent drilling fluid. In certain aspects, the size separating device 20 has one, two, three, four or more devices, in a parallel orientation. The active rig mud system returns drilling fluid with lost circulation material in it back to the wellbore from a mud pit 80 in a line 81.

The screen or screens of the size separation device 20 produce an undersize stream 21 of drilling fluid and most of the fine undesirable solids which have gone through the screen(s). Coarse undesirable solids, with a small amount of drilling fluid exits over the top surface of the screen(s) in a stream 22. In one aspect, the screen opening size is selected to be finer than the finest size of the lost circulation material, effectively sending the lost circulation material into stream 22 together with the coarse undesirable solids.

The drilling fluid and fine undesirable solids in stream 21 are, optionally, stored temporarily in a pit system 30. The mixture of lost circulation material and coarse undesirable solids in the stream 22 are separated next in an apparatus 40, e.g. by a device or machine for separating particles based on a combination of density plus fluid shear. The apparatus 40 is, in one aspect, a hydrocyclone or other similar device known to those skilled in the art. In certain circumstances, the apparatus 40 requires additional fluid in order to operate properly. A stream 71*a* is shown providing clean operating fluid produced by a downstream density and shear separation device 70. The apparatus 40 produces an overflow stream 41 and an underflow stream 42.

The overflow stream 41 consists almost exclusively of coarse lost circulation material, which is to be recovered and clean operating fluid. In certain aspects, due to inefficiency of the initial size separation device 20, it is possible that small amounts of fine undesirable materials are included in the stream 41. In this circumstance, provision can be made to separate the stream 41 by size using a size separator 50, using similar size separation equipment as already described for the device 20, which according to the present invention, maintains the alternation between separations based on size versus separations made by density plus fluid shear. In this case the separation in the separator 50 is made at a size that is finer than the lost circulation material. The separator 50 produces two streams: a stream 51 containing the operational fluid and the small amounts of fine undesirable solids that may have been contained in stream 22; and a stream 52 that contains economically clean lost circulation material which is returned to the well in a line 73 without subsequent processing.

The stream 42, produced by the apparatus 40, is a stream of coarse undesirable solids, with some amount of drilling fluid and fine undesirable solids. The stream 42 is treated by a size separator 60 to recover the drilling fluid, which according to the present invention, again maintains the alternation between separations based on size versus separations made by density plus fluid shear. If a screen is used, it produces a screen undersize stream 61 containing the drilling fluid with the small amount of fine undesirable solids, and a stream 62 containing coarse undesirable solids with economically acceptable small amounts of fluid, which is discarded.

In one particular aspect, a stream 31, exiting the storage pit 30 is combined with the streams 51, and 61 in a stream 63 which has all of the drilling fluid streams that contain primarily drilling fluid with a small amount of fine undesirable solids. The stream 63 is treated by a separator 70, which creates a stream of clean drilling fluid 71 which flows into a stream 73; and a stream of fine undesirable solids 72 which is discharged. The separator 70 can be a centrifugal separator, which according to the present invention, again maintains the alternation between separations based on size versus separations made by density plus fluid shear. As mentioned earlier, a portion of the clean drilling fluid may be returned to assist in separator 40, but the bulk of the stream flows to the mud pit 80, where the finishing touches to the fluid composition can be done. Reconditioned drilling fluid is pumped back to the well from the pit 80 in the stream 81.

Figure 2:
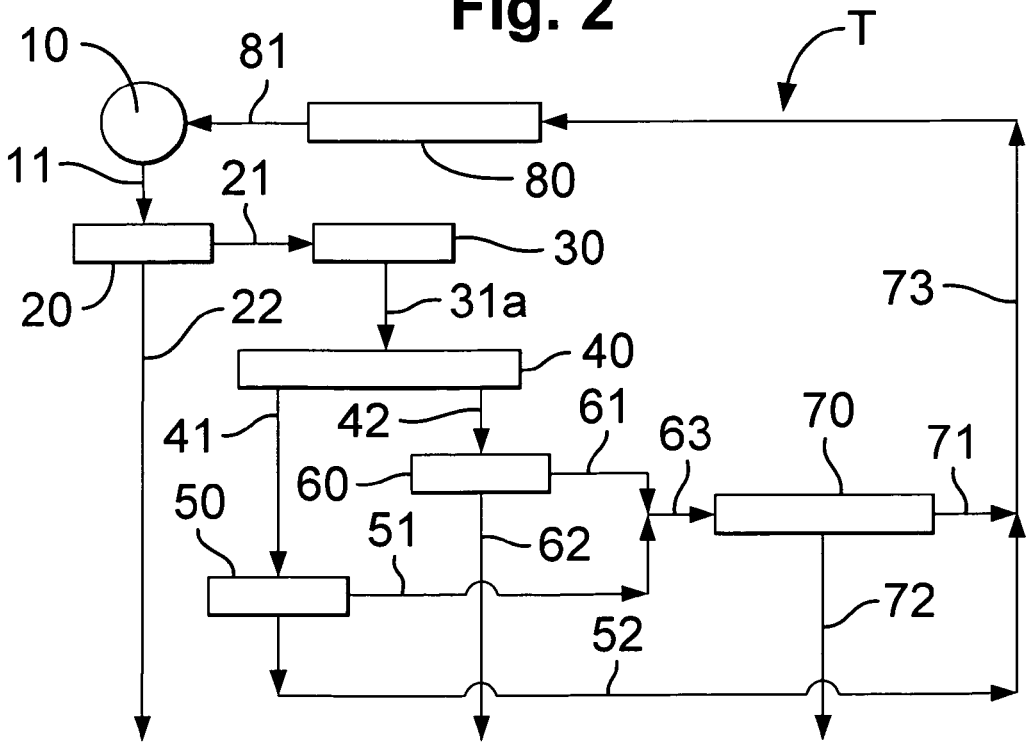
FIG. 2 is a schematic view illustrating a system and method according to the present invention.

FIG. 2 presents an alternate embodiment system T (generally like the system of FIG. 1A) and, up to the first size separator 20, like the system of FIG. 1B (and like numerals indicate like parts). The system of FIG. 2 is different from that of FIG. 1B in that the size of the separation made by size separator 20 is coarser than the coarsest size of the lost circulation material. The size separation apparatus has screen(s)

that produce an undersize stream (flows through the screen or screens). In the system T, the stream 22 exiting the size separating device 20 has no lost circulation material in it and is discarded. The stream 21 produced by the size separation device 20, which flows to the pit 30, has all (or substantially al) of the lost circulation material. A stream 31*a* from the pit 30 flows to the apparatus 40, after which it is treated in a similar fashion by separators 40, 50, 60 and 70 as is described in FIG. 1B. Again, FIG. 2 shows an alternation between size separations and density plus fluid drag separations.

Figure 3:
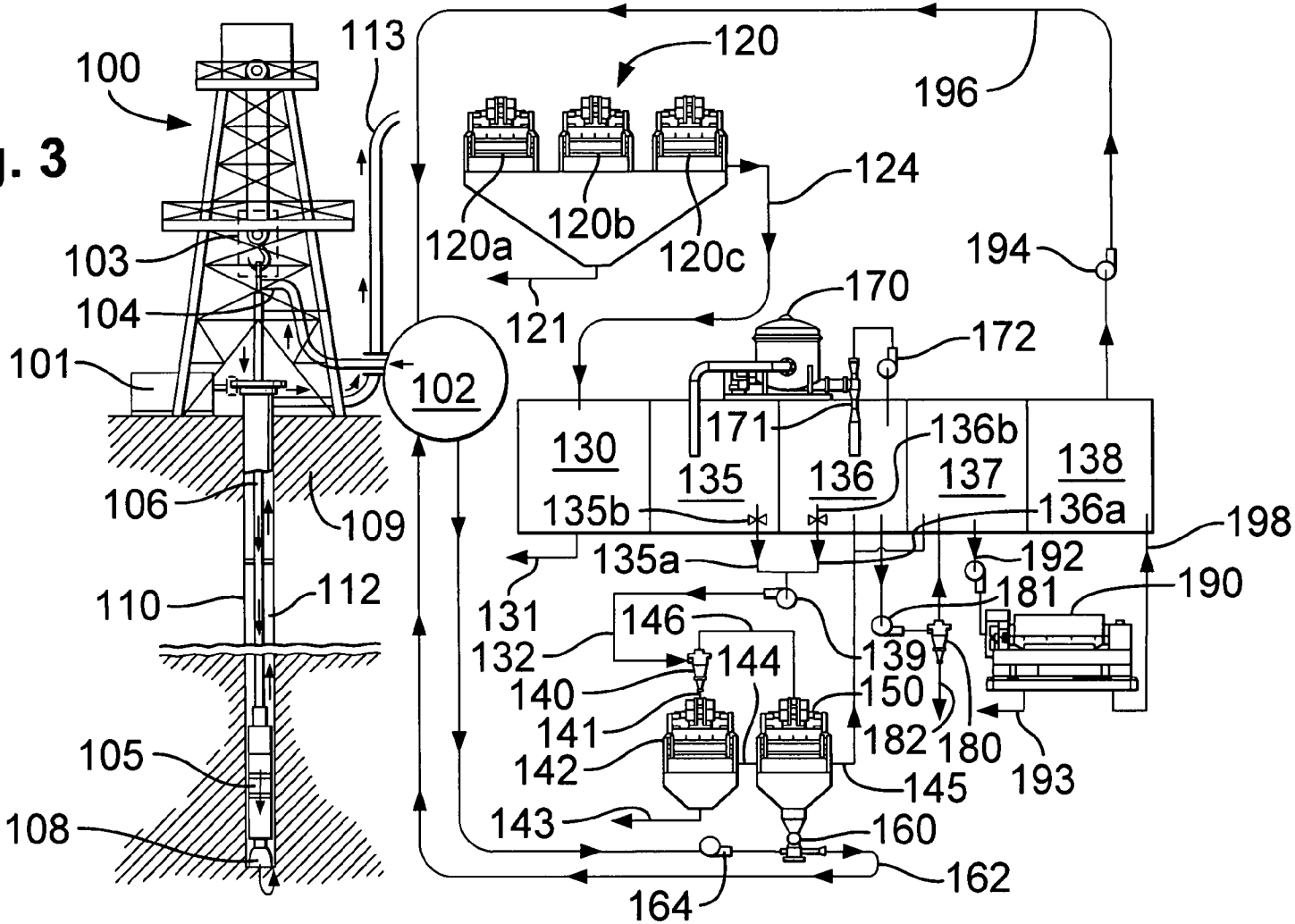
FIG. 3 is a schematic view illustrating a system and method according to the present invention.

FIG. 3 shows a system 100 according to the present invention, similar to the system T described above, but with additional equipment and in which an active rig mud system 102 pumps drilling fluid with lost circulation material therein in a line 104 into a tubular string 106 which extends down to a drill bit 108 in a wellbore 110 through an earth formation 109. The drill bit 108 is rotated by a rotary apparatus 101, a top drive system 103, and/or by a downhole motor 105. Spent drilling fluid exits the drill bit 108 and returns to the surface in an annulus 112 of the wellbore 110. This spent drilling fluid, in a line 113 containing lost circulation material is provided to shale shaker apparatus 120 which, as shown, includes three shale shakers 120*a*, 120*b*, and 120*c* which act as "scalping" shakers that remove very coarse items (particles, cuttings, debris) producing a stream 121 which exits from the top sides of screens of the shale shakers.

The shale shakers 120*a*, 120*b*, 120*c* produce streams with drilling fluid and lost circulation material (the fluid and lost circulation material having passed down through screens of the shale shakers). The drilling fluid and lost circulation material in a stream 124 falls by gravity or is pumped to a sand trap 130 in which coarse items settle to the bottom. The bulk of the lost circulation material generally does not settle to the bottom of the sand trap due to its low specific gravity. The coarse items are periodically removed from the sand trap in a line 131.

A stream 134 with drilling fluid, lost circulation material, and some undesirable solids is fed to a tank 135.

Streams 135*a* and 136*a* are pumped by a pump 139 in a line 132 to a hydrocyclone 140. The streams 135*a* and 136*a* contain primarily lost circulation material, drilling fluid, and some undesirable solids. The stream 136 is from a tank 136.

The hydrocyclone 140 produces a stream 141 of undesirable solids and some drilling fluid which is fed to a shale shaker 142. The shale shaker 142 produces an "overs" or oversize stream of separated solids 143 and a stream 144 of drilling fluid and some minimal amount of undesirable solids which has flowed through the screen(s) of the shale shaker(s) ("unders" or undersize) which flows by gravity or is pumped to the tank 136 and/or tank 137 in a line 145.

The hydrocyclone 140 produces a top ("overs" or overflow) stream 146 which is fed to a shale shaker 150. An "unders" or undersize stream of drilling fluid and some minimal amount of undesirable solids which has flowed through the screens of the shale shaker 150 is pumped or flows by gravity in the stream 145 to the tank 136 and/or tank 137. An "overs" or oversize flow of lost circulation material flows from the top sides of the screens of the shale shaker 150 to a jet hopper 160 which transfers the lost circulation material to the active rig mud system 102 in a line 162 for reuse. A pump 164 pumps fluid from the active rig mud system under high pressure to the jet hopper 160 to provide a high pressure flow for operation of the jet hopper 160.

A valve 135*b* selectively controls flow of the stream 135*a* and a valve 136*b* selectively controls flow of the stream 136*b*. Either or both streams 135*b*, 136*b* can feed the hydrocyclone 140. When the mud does not require a degasser, the valve 135*b* can be opened and valve 136*b* can be closed. When the mud does require de-gassing, valve 135*b* is closed, and valve 136*b* is opened.

Optionally, a degasser 170 removes gas from material in the tank 135 and, via a hopper 171 driven by a pump 172, feeds degassed material (drilling fluid, perhaps with some solids) into the tank 136.

Optionally, a desilter 180 treats fluid pumped to it from the tank 136 by a pump 181 and provides it to a tank 137. material (e.g., silt sized drilled rock) removed by the desilter 180 exits in a line 182.

Optionally, material in the stream 145 is provided to the tank 136 when the degasser is not in use and to the tank 137 when the degasser is in use.

Optionally, a pump 191 pumps a stream 192 (drilling fluid with some solids) to centrifuge apparatus 190 which processes the stream 192, producing separated solids which exit in a line 193 and cleaned drilling fluid in a stream 198 which is pumped or flows by gravity into a tank 138. A pump 194 pumps drilling fluid from the tank 138 in a line 196 back to the active rig mud system 102.

In one particular aspect, in the system 100: the shale shakers 120*a*, 120*b*, 120*c* have API-18 screens, the degasser 170 is a commercially-available DG-10 Degasser from National Oilwell Varco; the shale shakers 142 and 150 have API-100 screens; the centrifuge 190 is a Brandt HS-3400 from National Oilwell Varco; and inlet pressure at the hydrocyclone 140 is about 8 psi.

Optionally, all the shale shakers can be KING COBRA (trademark) shakers from National Oilwell Varco.

The present invention, therefore, in at least certain embodiments, provides a method for recovering lost circulation material from spent drilling fluid, the spent drilling fluid containing lost circulation material, drilling fluid, and undesirable solids, the method including: feeding spent drilling fluid to first sizing apparatus, the spent drilling fluid containing lost circulation material, drilling fluid, and undesirable solids; separating with the first sizing apparatus coarse material from a stream of spent drilling fluid, and producing a stream of processed spent drilling fluid with the lost circulation material herein; providing the stream of processed spent drilling fluid to a hydrocyclone; producing with the hydrocyclone a first stream and a second stream, the first stream containing undesirable solids; the second stream containing substantially all of the lost circulation material in the processed spent drilling fluid, and some of the undesirable solids; feeding the second stream to second sizing apparatus; the second sizing apparatus producing a primary stream with substantially all of the lost circulation material, and a secondary stream with drilling fluid and undesirable solids; and feeding the primary stream to fluid processing apparatus for re-use in a wellbore operation. Such a method may one or some, in any possible combination, of the following: feeding the second stream from the hydrocyclone to secondary sizing apparatus; and producing with the secondary sizing apparatus a third stream and a fourth stream, the third stream containing substantially all of the undesired solids fed to the secondary sizing apparatus and the fourth stream containing drilling fluid; feeding the fourth stream to the fluid processing apparatus for re-use in a wellbore operation; feeding the secondary stream to a centrifuge apparatus producing a first centrifuge stream and a second centrifuge stream; the first centrifuge stream containing undesirable solids; and the second centrifuge stream containing drilling fluid; feeding the second centrifuge stream to the fluid processing apparatus for re-use in a wellbore operation; wherein the first sizing apparatus is first shale shaker apparatus and the second sizing apparatus is second shale shaker apparatus; providing (in one aspect, continuously) lost circulation material to an active rig mud system with the fluid processing apparatus; feeding the drilling fluid from the fourth stream continuously to an active rig mud system with the fluid processing apparatus; wherein the first sizing apparatus includes sand trap apparatus; degassing with the degasser apparatus the stream of processed spent drilling fluid; the first sizing apparatus is shale shaker apparatus with screen apparatus, the shale shaker apparatus producing an oversize stream and an undersize stream, the oversize stream flowing off the top of the screen apparatus, the undersize stream flowing through the screen apparatus, and the oversize stream containing the lost circulation material, drilling fluid and undesirable solids, the oversize stream comprising the stream of processed spent drilling fluid; the first sizing apparatus is shale shaker apparatus with screen apparatus, the shale shaker apparatus producing an oversize stream and an undersize stream, the oversize stream flowing off the top of the screen apparatus, the undersize stream flowing through the screen apparatus, and the undersize stream containing the lost circulation material, drilling fluid and undesirable solids, the undersize stream comprising the stream of processed spent drilling fluid; and/or wherein the lost circulation material ranges in size in a largest dimension between forty microns and five hundred microns.

The present invention, therefore, in at least certain embodiments, provides a method for recovering lost circulation material from spent drilling fluid, the spent drilling fluid containing lost circulation material, drilling fluid, and undesirable solids, the method including: feeding spent drilling fluid to first sizing apparatus, the spent drilling fluid containing lost circulation material, drilling fluid, and undesirable solids; separating with sizing apparatus coarse material from a stream of spent drilling fluid, and producing a stream of processed spent drilling fluid with the lost circulation material herein; providing the stream of processed spent drilling fluid to a hydrocyclone; producing with the hydrocyclone a first stream and a second stream, the first stream containing undesirable solids; the second stream containing substantially all of the lost circulation material in the processed spent drilling fluid apparatus, drilling fluid, and some of the undesirable solids; feeding the second stream to second sizing apparatus; the second sizing apparatus producing a primary stream with substantially all of the lost circulation material, and a secondary stream with drilling fluid and undesirable solids; feeding the primary stream continuously to an active rig mud system for re-use in a wellbore operation; feeding the secondary stream to a centrifuge apparatus producing a first centrifuge stream and a second centrifuge stream; the first centrifuge stream containing undesirable solids; the second centrifuge stream containing drilling fluid; feeding the second centrifuge stream continuously to the fluid processing apparatus for re-use in a wellbore operation; and wherein the first sizing apparatus is first shale shaker apparatus and the second sizing apparatus is second shale shaker apparatus.

The present invention, therefore, in at least certain embodiments, provides a method for recovering lost circulation material from spent drilling fluid, the spent drilling fluid containing lost circulation material, drilling fluid, and undesirable solids, the method including: feeding spent drilling fluid to first sizing apparatus, the spent drilling fluid containing lost circulation material, drilling fluid, and undesirable solids; separating with sizing apparatus coarse material from a stream of spent drilling fluid, and producing a stream of processed spent drilling fluid with the lost circulation material therein; providing the stream of processed spent drilling fluid to a hydrocyclone; producing with the hydrocyclone a first stream and a second stream, the first stream containing undesirable solids; the second stream containing substantially all of the lost circulation material in the processed spent drilling fluid, and some of the undesirable solids; feeding the second stream to second sizing apparatus; the second sizing apparatus producing a primary stream with substantially all of the lost circulation material, and a secondary stream with drilling fluid and undesirable solids; feeding the primary stream to fluid processing apparatus for re-use in a wellbore operation; the first sizing apparatus is shale shaker apparatus with screen apparatus, the shale shaker apparatus producing an oversize stream and an undersize stream; the oversize stream flowing off the top of the screen apparatus; the undersize stream flowing through the screen apparatus; one of the undersize stream or the oversize stream containing the lost circulation material, drilling fluid and undesirable solids; the stream containing the lost circulation material, drilling fluid, and undesirable solids comprising the stream of processed spent drilling fluid; and continuously providing lost circulation material to an active rig mud system with the fluid processing apparatus.

The present invention, therefore, in at least certain embodiments, provides a system for recovering lost circulation material for re-use in a wellbore operation, the lost circulation material in a stream of spent drilling fluid, the spent drilling fluid also containing drilling fluid and undesirable solids, the system including: first sizing apparatus for receiving a stream of spent drilling fluid, the spent drilling fluid containing lost circulation material, drilling fluid, and undesirable solids, the first sizing apparatus for separating coarse material from the stream of spent drilling fluid, and producing a stream of processed spent drilling fluid with the lost circulation material herein; a hydrocyclone for receiving and processing the stream of processed spent drilling fluid to a hydrocyclone, the hydrocyclone for producing a first stream and a second stream, the first stream containing undesirable solids; the second stream containing substantially all of the lost circulation material in the processed spent drilling fluid, and some of the undesirable solids; a second sizing apparatus for receiving and processing the second stream, the second sizing apparatus for producing a primary stream with substantially all of the lost circulation material, and a secondary stream with drilling fluid and undesirable solids; and fluid processing apparatus for feeding the primary stream for re-use in a wellbore operation. Such a method may one or some, in any possible combination, of the following: the separation apparatus for receiving the secondary stream and for producing a fourth stream containing drilling fluid; the fluid processing apparatus for receiving the fourth stream and feeding the fourth stream continuously for re-use in a wellbore operation; the separation apparatus is a centrifuge apparatus for producing a first centrifuge stream and a second centrifuge stream, the first centrifuge stream containing undesirable solids, the second centrifuge stream containing drilling fluid for re-use in a wellbore operation; and/or the first sizing apparatus is shale shaker apparatus with screen apparatus, the shale shaker apparatus producing an oversize stream and an undersize stream, the oversize stream flowing off the top of the screen apparatus, the undersize stream flowing through the screen apparatus, and one of the undersize stream and the oversize stream containing the lost circulation material, drilling fluid and undesirable solids, the stream containing the lost circulation material, the drilling fluid and undesirable solids comprising the stream of processed spent drilling fluid.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A method for recovering lost circulation material from spent drilling fluid, the spent drilling fluid containing lost circulation material, drilling fluid, and undesirable solids, the undesirable solids including coarse solids and fine solids, the method comprising:

feeding spent drilling fluid to first sizing apparatus, the spent drilling fluid containing lost circulation material, drilling fluid, and undesirable solids, the undesirable solids including coarse solids and fine solids;

with the first sizing apparatus separating the stream of spent drilling fluid, producing a first stream of coarse solids, drilling fluid, and lost circulation material and a second stream of drilling fluid and fine solids;

providing the first stream to a hydrocyclone;

producing with the hydrocyclone an overflow stream and an underflow stream, the overflow stream containing lost circulation material, the underflow stream containing coarse solids, drilling fluid, and fine solids;

feeding the overflow stream to second sizing apparatus; the second sizing apparatus producing a primary stream with the lost circulation material, and a secondary stream with drilling fluid and undesirable solids; and returning the primary stream to fluid processing apparatus for re-use in a wellbore operation.

2. The method of claim 1 further comprising:

feeding the secondary stream to a centrifuge apparatus producing a first centrifuge stream and a second centrifuge stream;

the first centrifuge stream containing undesirable solids;

the second centrifuge stream containing drilling fluid; and feeding the second centrifuge stream to fluid processing apparatus for re-use in a wellbore operation.

3. The method of claim 1 wherein the first sizing apparatus is first shale shaker apparatus and the second sizing apparatus is second shale shaker apparatus.

4. The method of claim 1 further comprising:

feeding the second stream to a centrifuge apparatus producing a first centrifuge stream and a second centrifuge stream;

the first centrifuge stream containing undesirable solids;

the second centrifuge stream containing drilling fluid; and feeding the second centrifuge stream to fluid processing apparatus for re-use in a wellbore operation.

5. The method of claim 1 further comprising:

feeding the underflow stream to a third sizing apparatus producing a third stream with drilling fluid and fine solids.

6. The method of claim 5 further comprising:

feeding the third stream to a centrifuge apparatus producing a first centrifuge stream and a second centrifuge stream;

the first centrifuge stream containing undesirable solids;

the second centrifuge stream containing drilling fluid; and feeding the second centrifuge stream to fluid processing apparatus for re-use in a wellbore operation.

7. The method of claim 1 further comprising:

feeding clean drilling fluid to the hydrocyclone to facilitate operation of the hydrocyclone.

8. The method of claim 7 wherein the clean fluid is produced by a centrifuge, the method further comprising feeding at least one of the second stream, part of the underflow stream, and part of the overflow stream to the centrifuge; and producing therefrom the clean drilling fluid.

9. A method for recovering lost circulation material from spent drilling fluid, the spent drilling fluid containing lost circulation material, drilling fluid, and undesirable solids, the undesirable solids including coarse solids and fine solids, the method comprising:

feeding spent drilling fluid to first sizing apparatus, the spent drilling fluid containing lost circulation material, drilling fluid, and undesirable solids, the undesirable solids including coarse solids and fine solids;

with the first sizing apparatus separating the stream of spent drilling fluid, producing a first stream of coarse solids, drilling fluid, and lost circulation material and a second stream of drilling fluid and fine solids;

providing the first stream to a hydrocyclone;

producing with the hydrocyclone an overflow stream and an underflow stream, the overflow stream containing lost circulation material, the underflow stream containing coarse solids, drilling fluid, and fine solids;

feeding the overflow stream to second sizing apparatus; the second sizing apparatus producing a primary stream with the lost circulation material, and a secondary stream with drilling fluid and undesirable solids;

returning the primary stream to fluid processing apparatus for re-use in a wellbore operation;

feeding the secondary stream to a centrifuge apparatus producing a first centrifuge stream and a second centrifuge stream;

the first centrifuge stream containing undesirable solids;

the second centrifuge stream containing drilling fluid;

feeding the second centrifuge stream to fluid processing apparatus for re-use in a wellbore operation;

wherein the first sizing apparatus is first shale shaker apparatus and the second sizing apparatus is second shale shaker apparatus;

feeding at least one of the second stream, part of the underflow stream, and part of the overflow stream to a centrifuge and producing therefrom with the centrifuge the clean drilling fluid; and feeding clean drilling fluid to the hydrocyclone to facilitate operation of the hydrocyclone.

10. A system for recovering lost circulation material for re-use in a wellbore operation, the lost circulation material in a stream of spent drilling fluid, the spent drilling fluid also containing drilling fluid and undesirable solids, the undesirable solids including coarse solids and fine solids, the system comprising:

first sizing apparatus for receiving a stream of spent drilling fluid, the spent drilling fluid containing lost circulation material, drilling fluid, and undesirable solids, the undesirable solids including coarse solids and fine solids, the first sizing apparatus for separating components of the stream of spent drilling fluid and for producing a first stream of coarse solids and lost circulation material and a second stream of drilling fluid and fine solids;

a hydrocyclone for receiving and processing the first stream, the hydrocyclone for producing an overflow stream and an underflow stream, the overflow stream containing lost circulation material, the underflow stream containing coarse solids, drilling fluid, and fine solids;

a second sizing apparatus for receiving and processing the overflow stream, the second sizing apparatus for producing a primary stream with the lost circulation material, and a secondary stream with drilling fluid and fine solids; and fluid processing apparatus for feeding the primary stream for re-use in a wellbore operation.

11. The system of claim 10 further comprising:

separation apparatus for receiving the secondary stream and for producing a fourth stream containing drilling fluid;

the fluid processing apparatus for receiving the fourth stream and feeding the fourth stream continuously for re-use in a wellbore operation.

12. The system of claim 11 wherein the separation apparatus is a centrifuge apparatus for producing a first centrifuge stream and the fourth stream.

13. The system of claim 10 wherein the first sizing apparatus is shale shaker apparatus with screen apparatus, the shale shaker apparatus producing an oversize first stream and an undersize second stream, the oversize first stream flowing off the top of the screen apparatus, the undersize second stream flowing through the screen apparatus, and the oversize first stream containing the lost circulation material, drilling fluid and coarse solids.

14. The system of claim 10 further comprising secondary feed apparatus for producing a tertiary stream of drilling fluid and for feeding the tertiary stream of drilling fluid to the hydrocyclone to facilitate operation of the hydrocyclone.

15. The system of claim 14 wherein the secondary feed apparatus comprises centrifuge apparatus.

16. The system of claim 15 wherein the secondary feed apparatus can receive at least one of the second stream, part of the underflow stream, and part of the overflow stream from which to produce the tertiary stream.

17. Lost circulation material recovered from a stream of spent drilling fluid by a method, the stream of spent drilling fluid including lost circulation material, drilling fluid, and undesirable solids, the method comprising:

feeding spent drilling fluid to first sizing apparatus, the spent drilling fluid containing lost circulation material, drilling fluid, and undesirable solids, the undesirable solids including coarse solids and fine solids;

with the first sizing apparatus separating the stream of spent drilling fluid, producing a first stream of coarse solids, drilling fluid, and lost circulation material and a second stream of drilling fluid and fine solids;

providing the first stream to a hydrocyclone;

producing with the hydrocyclone an overflow stream and an underflow stream, the overflow stream containing lost circulation material and drilling fluid and undesirable solids; the underflow stream containing coarse solids and drilling fluid and fine solids;

feeding the overflow stream to second sizing apparatus; the second sizing apparatus producing a primary stream with the lost circulation material, and a secondary stream with drilling fluid and undesirable solids; and returning the primary stream to fluid processing apparatus for re-use in a wellbore operation.

* * * * *